US005933093A

United States Patent [19]

Austin, II

[11] Patent Number: 5,933,093

[45] Date of Patent: Aug. 3, 1999

[54] EMERGENCY VEHICLE ALERT DEVICE

[76] Inventor: John H. Austin, II, 1828 Calstock St., Carson, Calif. 90746

[21] Appl. No.: 09/026,576

[22] Filed: Feb. 20, 1998

[51] Int. Cl.[6] ..... G08B 1/00

[52] U.S. Cl. ..... 340/902; 340/825.54; 340/825.57; 340/825.72; 340/904; 340/906; 340/907

[58] Field of Search ..... 340/902, 901, 340/943, 904, 903, 907, 906, 825.34, 825.36, 825.73, 825.57, 825.72, 825.54; 455/45; 375/1

[56] References Cited

U.S. PATENT DOCUMENTS

| | | | |
|---|---|---|---|
| 4,209,769 | 6/1980 | Chronerberry | 340/902 |
| 4,952,931 | 8/1990 | Serageldin et al. | 340/902 |
| 5,278,553 | 1/1994 | Cornett et al. | 340/902 |
| 5,303,259 | 4/1994 | Loveall | 340/902 |
| 5,559,508 | 9/1996 | Orr et al. | 340/902 |
| 5,572,201 | 11/1996 | Graham et al. | 340/902 |
| 5,757,284 | 5/1998 | Trizzino et al. | 340/902 |

*Primary Examiner*—Edward Lefkowitz
*Assistant Examiner*—Davetta Woods

[57] ABSTRACT

An emergency vehicle alert device including a transmitter secured within an emergency vehicle. A receiver is secured within a non-emergency vehicle. The receiver cooperates with the transmitter for receiving a signal therefrom. The receiver couples with an existing emergency flasher fuse in a fuse box of the non-emergency vehicle for activation of emergency flashers upon receiving a signal from the transmitter.

4 Claims, 3 Drawing Sheets

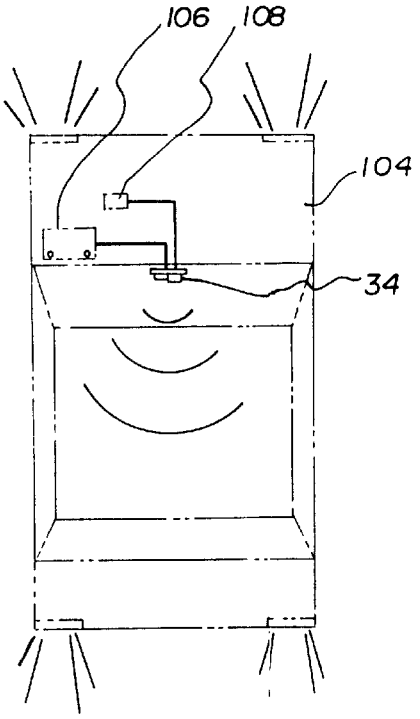
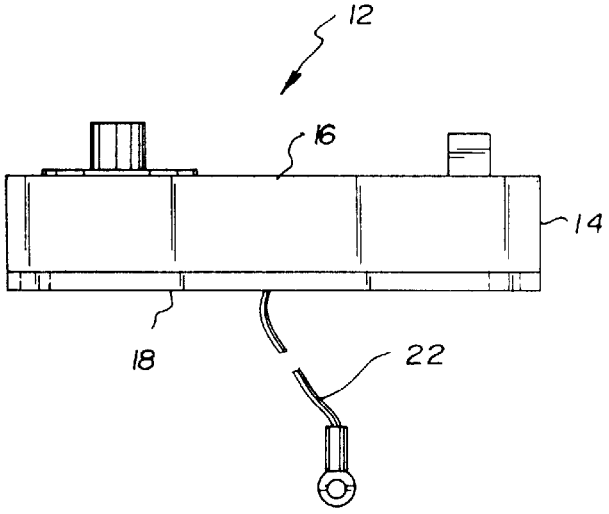
FIG. 2
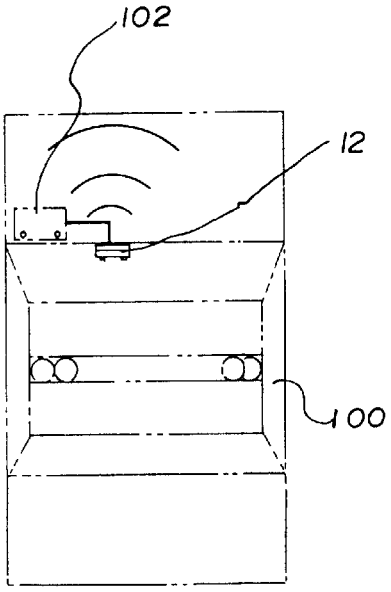
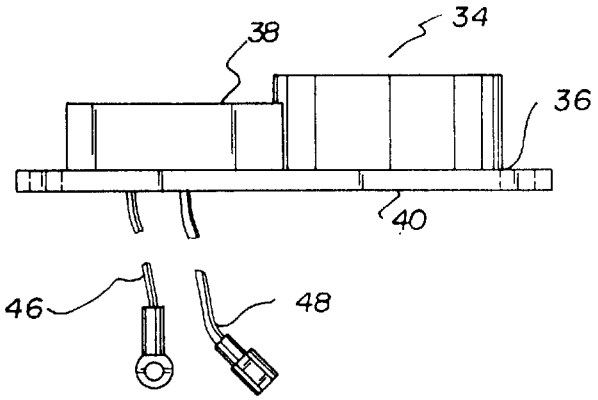
FIG. 3
FIG. 1

EMERGENCY VEHICLE ALERT DEVICE

BACKGROUND OF THE INVENTION

1. Field of the Invention

The present invention relates to an emergency vehicle alert device and more particularly pertains to warning driver's of vehicles of an approaching emergency vehicle and providing a signal theretofore with an emergency vehicle alert device.

2. Description of the Prior Art

The use of proximity warning system is known in the prior art. More specifically, proximity warning system heretofore devised and utilized for the purpose of warning drivers of an approaching emergency vehicle are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,238,778 to Ohsumi discloses a system for warning the approach of an emergency vehicle.

U.S. Pat. No. 4,794,394 to Halstead discloses an emergency vehicle proximity warning system.

U.S. Pat. No. Des. 345,116 to Cardinalli discloses the ornamental design for an emergency vehicle proximity warning signal.

U.S. Pat. No. Des. 351,805 to Pagano discloses the ornamental design for a transmitter for an emergency vehicle warning system.

U.S. Pat. No. 4,747,064 to Johnston discloses an approaching vehicle informing system and method.

U.S. Pat. No. 4,764,978 to Argo et al. discloses an emergency vehicle radio transmission system.

While these devices fulfill their respective, particular objective and requirements, the aforementioned patents do not describe an emergency vehicle alert device for warning driver's of vehicles of an approaching emergency vehicle and providing a signal theretofore.

In this respect, the emergency vehicle alert device according to the present invention substantially departs from the conventional concepts and designs of the prior art, and in doing so provides an apparatus primarily developed for the purpose of warning driver's of vehicles of an approaching emergency vehicle and providing a signal theretofore.

Therefore, it can be appreciated that there exists a continuing need for new and improved emergency vehicle alert device which can be used for warning driver's of vehicles of an approaching emergency vehicle and providing a signal theretofore. In this regard, the present invention substantially fulfills this need.

SUMMARY OF THE INVENTION

In the view of the foregoing disadvantages inherent in the known types of proximity warning system now present in the prior art, the present invention provides an improved emergency vehicle alert device. As such, the general purpose of the present invention, which will be described subsequently in greater detail, is to provide a new and improved emergency vehicle alert device and method which has all the advantages of the prior art and none of the disadvantages.

To attain this, the present invention essentially comprises a transmitter secured within an emergency vehicle. The transmitter comprises a housing having a top surface, a bottom surface and a hollow interior therebetween. The transmitter has a power line extending outwardly of the housing to couple with a battery of the emergency vehicle. A transmitting means is secured within the hollow interior. The transmitting means is coupled with the power line. A range adjuster extends outwardly from the top surface of the housing. The range adjuster is coupled with the transmitting means. An antenna extends outwardly of the housing. The antenna is coupled with the transmitter. An on/off switch extends outwardly from a top surface of the housing. The on/off switch couples with the transmitting means for selective activation or deactivation thereof. A receiver is secured within a non-emergency vehicle. The receiver comprises a receiver housing having a top surface, a bottom surface and a hollow interior therebetween. A signal receiving means is secured within the top surface of the receiver housing. The-signal receiving means cooperates with the transmitting means of the transmitter. A first power line extends outwardly of the receiver housing from the signal receiving means therein to couple with a battery of the non-emergency vehicle. A second power line extends outwardly of the signal receiving means of the receiver housing to couple with an existing emergency flasher fuse in a fuse box of the non-emergency vehicle. A speaker is linked to the top surface of the receiver housing and coupled with the signal receiving means.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved emergency vehicle alert device which has all the advantages of the prior art proximity warning system and none of the disadvantages.

It is another object of the present invention to provide a new and improved emergency vehicle alert device which may be easily and efficiently manufactured and marketed.

It is a further object of the present invention to provide a new and improved emergency vehicle alert device which is of durable and reliable construction.

An even further object of the present invention is to provide a new and improved emergency vehicle alert device which is susceptible of a low cost of manufacture with regard to both materials and labor, and which accordingly is then susceptible of low prices of sale to the consuming public, thereby making such an emergency vehicle alert device economically available to the buying public.

Yet another object of the present invention is to avoid undue delay to those vehicles not in conflict with an emergency vehicle. By placing a ten second clock within both the emergency vehicle and non-emergency vehicle. This would limit disruption to the flow of traffic. The emergency vehicle will deploy a seven second warning signal. The non-emergency vehicle will display to the motorist a three second warning within the ten second scope.

Still yet another object of the present invention is to provide a new and improved emergency vehicle alert device which provides in the apparatuses and methods of the prior art some of the advantages thereof, while simultaneously overcoming some of the disadvantages normally associated therewith.

Even still another object of the present invention is to provide a new and improved emergency vehicle alert device for warning driver's of vehicles of an approaching emergency vehicle and providing a signal theretofore.

Lastly, it is an object of the present invention to provide a new and improved emergency vehicle alert device including a transmitter secured within an emergency vehicle. A receiver is secured within a non-emergency vehicle. The receiver cooperates with the transmitter for receiving a signal therefrom. The receiver couples with an emergency flasher fuse in a fuse box of the non-emergency vehicle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of the preferred embodiment of the emergency vehicle alert device constructed in accordance with the principles of the present invention.

FIG. 2 is a side elevation view of the transmitter of the present invention.

FIG. 3 is a side elevation view of the receiver of the present invention.

The same reference numerals refer to the same parts through the various Figures.

DESCRIPTION OF THE PREFERRED EMBODIMENT

Figure 5:
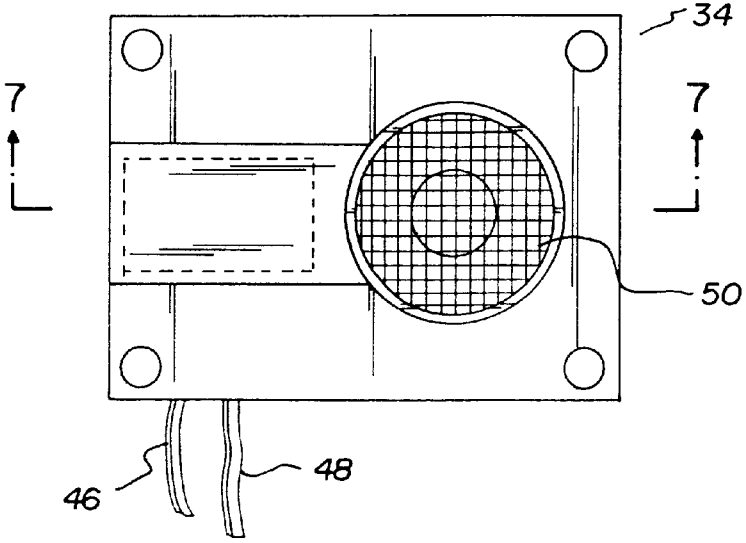
FIG. 5 is a plan view of the receiver of the present invention.
Figure 4:
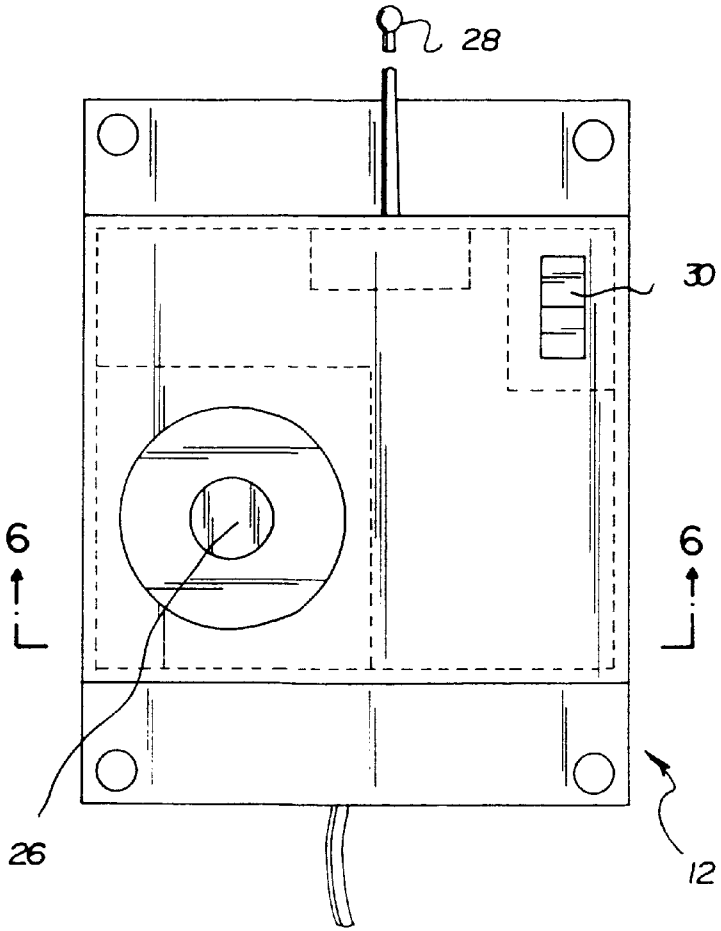
FIG. 4 is a plan view of the transmitter of the present invention.
Figures 6, 7:
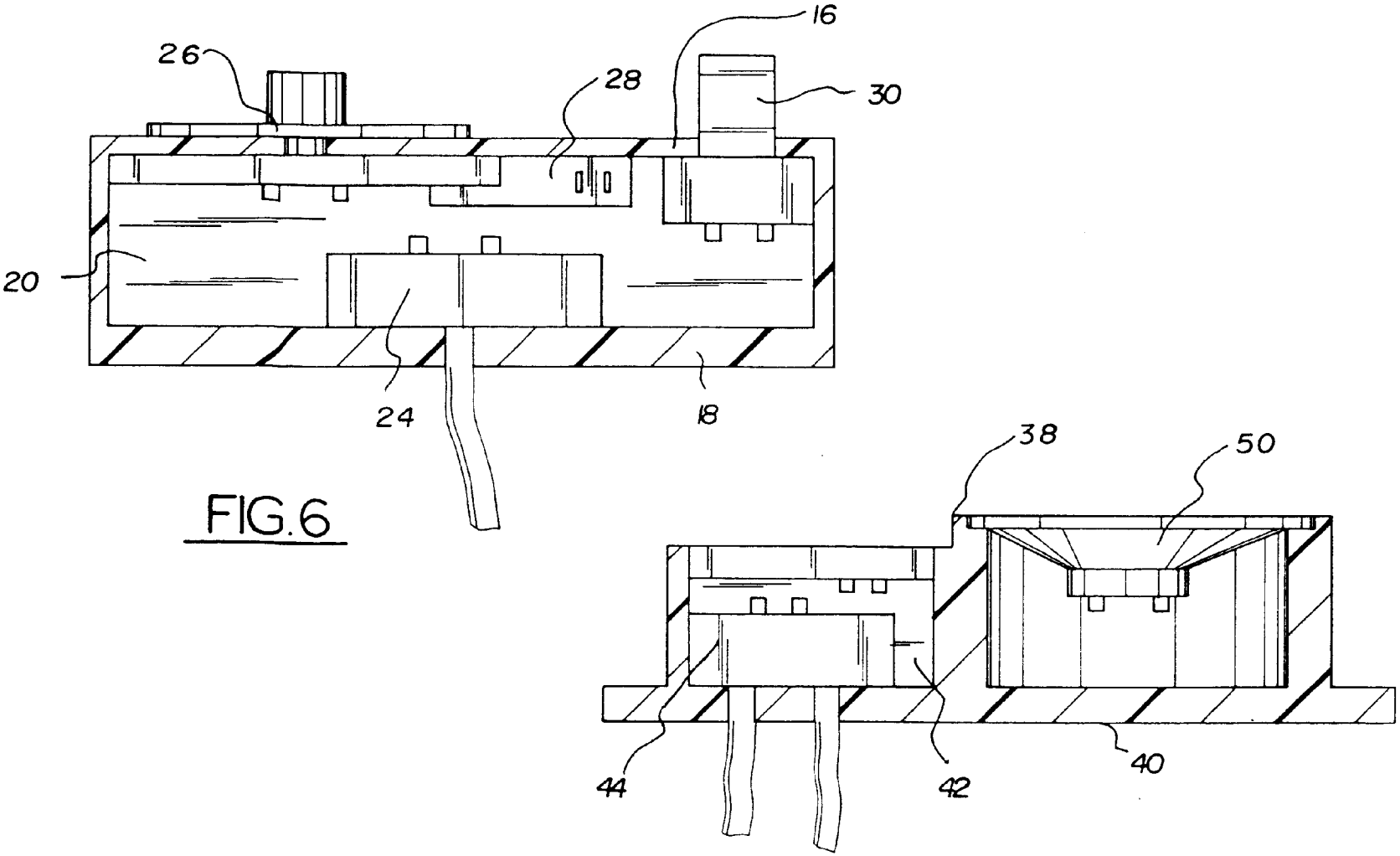
FIG. 6 is a cross-sectional view as taken along line 6—6 of FIG. 4.
FIG. 7 is a cross-sectional view as taken along line 7—7 of FIG. 5.

With reference now to the drawings, and in particular, to FIGS. 1–7 thereof, the preferred embodiment of the new and improved emergency vehicle alert device embodying the principles and concepts of the present invention and generally designated by the reference number 10 will be described.

Specifically, it will be noted in the various Figures that the device relates to a emergency vehicle alert device for warning driver's of vehicles of an approaching emergency vehicle and providing a signal theretofore. In its broadest context, the device consists of a transmitter and a receiver. Such components are individually configured and correlated with respect to each other so as to attain the desired objective.

The device 10 includes a transmitter 12 secured within an emergency vehicle 100. The transmitter 12 comprises a housing 14 having a top surface 16, a bottom surface 18 and a hollow interior 20 therebetween. The transmitter 12 has a power line 22 extending outwardly of the housing 14 to couple with a battery 102 of the emergency vehicle 100. A transmitting means 24 is secured within the hollow interior 20. The transmitting means 24 is coupled with the power line 22. A range adjuster 26 is linked to the top surface 16 of the housing 14. The range adjuster 26 is coupled with the transmitting means 24. An antenna 28 extends outwardly of the housing 14. The antenna 28 is coupled with the transmitting means 24. An on/off switch 30 is linked to a top surface 16 of the housing 14. The on/off switch 30 couples with the transmitting means 24 for selective activation or deactivation thereof. The range adjuster 26 allows for a signal created by the transmitting means 24 to be adjusted as to how far the signal is transmitted (not to exceed five hundred feet). The emergency vehicle operator will simply turn the on/off switch 30 to the "on" position to activate the transmitting means 24 to send the signal out through the antenna to recipient receivers who will be warned of an approaching emergency vehicle.

Associated with the transmitter 12 is a receiver 34. The receiver 34 is secured within a non-emergency vehicle 104. The receiver 34 is placed in a position within the non-emergency vehicle that is most convenient to an operator of the non-emergency vehicle. The receiver 34 comprises a receiver housing 36 having a top surface 38, a bottom surface 40 and a hollow interior 42 therebetween. A signal receiving means 44 is secured within the top surface 38 of the receiver housing 36. The signal receiving means 44 cooperates with the transmitting means 24 of the transmitter 12. A first power line 46 extends outwardly of the receiver housing 36 from the signal receiving means 44 therein to couple with a battery 106 of the non-emergency vehicle 104. A second power line 48 extends outwardly of the signal receiving means 44 of the receiver housing 36 to couple with an emergency flasher fuse in a fuse box 108 of the non-emergency vehicle 104. A speaker 50 is secured within the top surface 38 of the receiver housing 36 and coupled with the signal receiving means 44. The signal receiving means 44 receives the transmitted signal from the transmitting means 24 of the transmitter 12 which will send an audible signal through the speaker 50 to alert the driver of the non-emergency vehicle 104 to an approaching emergency vehicle 100. Preferably, the receiver housing, has associated therewith an indicator light which illuminates coincidentally with the transmission of the audio signal by the speaker. As such, a visual indication of the presence of the emergency vehicle is provided which is intended for alerting the driver of the non-emergency vehicle. Additionally, the signal receiving means 44 will cause the emergency flashers of the non-emergency vehicle 104 to be activated. This is accomplished by transmitting power to the flashers by way of the fuse box. The flashing of the emergency flashers of the non-emergency vehicle is critical for indicating to the driver of the emergency vehicle and other vehicles that the present driver has been alerted to the presence of the emergency vehicle.

Further options include a timer incorporated within the transmitter for intermittently transmitting the associated signal with a duty cycle having an on-time of 7 seconds and an off-time of 3 seconds after actuation by means of the switch. Also, the receiver includes a timer for responding to the signal for 3 seconds upon each receipt of the signal. The combination of these delays works to prevent a vehicle leaving the presence of the emergency vehicle from being affected by the present invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An emergency vehicle alert device for warning driver's of vehicles of an approaching emergency vehicle and providing a signal theretofore comprising, in combination:

a transmitter secured within an emergency vehicle, the transmitter comprising a housing having a top surface, a bottom surface and a hollow interior therebetween, the transmitter having a power line extending outwardly of the housing to couple with a battery of the emergency vehicle, a transmitting means secured within the hollow interior, the transmitting means coupled with the power line, a range adjuster being linked to the top surface of the housing, the range adjuster coupled with the transmitting means, an antenna extending outwardly of the housing, the antenna coupled with the transmitter, an on/off switch being linked to a top surface of the housing, the on/off switch coupling with the transmitting means for selective activation or deactivation thereof, a timer incorporated within the transmitter, the timer having a duty cycle of 7 seconds of transmission followed by 3 seconds of delay;

a receiver secured within a non-emergency vehicle, the receiver comprising a receiver housing having a top surface, a bottom surface and a hollow interior therebetween, a signal receiving means secured within the top surface of the receiver housing, the signal receiving means cooperating with the transmitting means of the transmitter, the duty cycle of the timer functioning to prevent a receiver which is leaving the presence of an emergency vehicle from being completely activated, a first power line extending outwardly of the receiver housing from the signal receiving means therein to couple with a battery of the non-emergency vehicle, a second power line extending outwardly of the signal receiving means of the receiver housing to couple with an existing emergency flasher fuse in a fuse box of the non-emergency vehicle, a speaker secured within the top surface of the receiver housing and coupled with the signal receiving means.

2. An emergency vehicle alert device comprising:

a transmitter secured within an emergency vehicle, a timer incorporated within the transmitter, the timer having a duty cycle of 7 seconds of transmission followed by 3 seconds of delay;

a receiver secured within a non-emergency, the receiver cooperating with the transmitter for receiving a signal therefrom, the duty cycle of the timer functioning to prevent a receiver which is leaving the presence of an emergency vehicle from being completely activated, the receiver coupling with an existing emergency flasher fuse in a fuse box of the non-emergency vehicle.

3. The emergency vehicle alert device as set forth in claim 2 wherein the transmitter comprising a housing having a top surface, a bottom surface and a hollow interior therebetween, the transmitter having a power line extending outwardly of the housing to couple with a battery of the emergency vehicle, a transmitting means secured within the hollow interior, the transmitting means coupled with the power line, a range adjuster linked to the top surface of the housing, the range adjuster coupled with the transmitting means, an antenna extending outwardly of the housing, the antenna coupled with the transmitter, an on/off switch linked to a top surface of the housing, the on/off switch coupling with the transmitting means for selective activation or deactivation thereof.

4. The emergency vehicle alert device as set forth in claim 2 wherein the receiver comprising a receiver housing having a top surface, a bottom surface and a hollow interior therebetween, a signal receiving means secured within the top surface of the receiver housing, the signal receiving means cooperating with the transmitter, a first power line extending outwardly of the receiver housing from the signal receiving means therein to couple with a battery of the non-emergency vehicle, a second power line extending outwardly of the signal receiving means of the receiver housing to couple with the emergency flasher fuse in the fuse box of the non-emergency vehicle, a speaker secured within the top surface of the receiver housing and coupled with the signal receiving means.

* * * * *